United States Patent [19]

Nakano

[11] Patent Number: 4,919,315

[45] Date of Patent: Apr. 24, 1990

[54] APPARATUS FOR FINISHING PANTYHOSE

[75] Inventor: Makoto Nakano, Yamatotakada, Japan

[73] Assignees: Takatori Corporation; Takatori Hitech C., Ltd., both of Nara, Japan

[21] Appl. No.: 334,885

[22] Filed: Mar. 30, 1989

[30] Foreign Application Priority Data

Mar. 31, 1988 [JP] Japan ..... 63-81115

[51] Int. Cl.[5] ..... D06C 5/00

[52] U.S. Cl. ..... 223/76; 223/60; 223/112

[58] Field of Search ..... 223/76, 60, 75, 61, 223/77, 43, 112; 112/121.15

[56] References Cited

U.S. PATENT DOCUMENTS

| | | | |
|---|---|---|---|
| 3,333,748 | 8/1967 | Horberg | 223/76 |
| 4,421,259 | 12/1983 | Sewell et al. | 223/112 X |
| 4,491,255 | 1/1985 | LaChapelle | 223/112 X |
| 4,515,299 | 5/1985 | Sewell et al. | 223/76 |
| 4,658,995 | 4/1987 | Teague | 223/112 X |
| 4,726,497 | 2/1988 | Glaze | 223/60 |

*Primary Examiner*—H. Hampton Hunter

*Attorney, Agent, or Firm*—Wenderoth, Lind & Ponack

[57] ABSTRACT

An apparatus for automatically finishing pantyhose includes pairs of pattern frames on which a pair of pantyhose are fitted and which are respectively mounted on a revolving ring plate which stops at stations for pantyhose inspection, drying, and pulling-out. At the inspection station, the pattern frames are lifted by an elevating device and their width is increased for inspection of the pantyhose. At the drying station, they are dried and set to the shape of the widened pattern frames by an infrared heater. At the pulling-out station, a device clamps their toe portion and pulls them into a folding device, a lowering device lowers the pattern frames and narrows their widths, and a tucking-up device is lifted so as to raise the mouth portion of the pantyhose. The folding device folds them in two before they are forwarded to a packaging station.

7 Claims, 7 Drawing Sheets

APPARATUS FOR FINISHING PANTYHOSE

BACKGROUND OF THE INVENTION

This invention relates to an apparatus for inspecting, drying, and finishing dyed pantyhose continuously in an automatic manner. The finishing process of dyed pantyhose generally comprises inspecting, drying, heat-setting, and packaging.

Shortly after being dyed, pantyhose are still wet and wrinkled, so that a heat-setting process is generally carried out during the drying of the pantyhose to simply remove such wrinkles. When packed in a carton or bag, pantyhose do not need to be completely free of wrinkles. Therefore, pantyhose can have merchandise value despite being finished by only a simply drying process.

Hitherto, the inspecting, drying, and heat-setting processes of pantyhose have been conducted one after another in a separate manner. Because of that, considerable manpower is required on each machine carrying out the separate processes in order to fit on or take off pantyhose therefrom, and this inevitably contributes to a poor productivity and the production cost is hard to reduce.

SUMMARY OF THE INVENTION

Accordingly, it is an object of this invention to provide an apparatus for automatically inspecting, drying, and heat-setting dyed pantyhose in a continuous manner, by only placing the pantyhose on pattern frames. It is another object of this invention to provide an apparatus for finishing pantyhose capable of reducing the production cost due to the increased performance and superior working efficiency associated with such automation.

BRIEF DESCRIPTION OF THE DRAWINGS

The above and other objects and features of this invention will appear more fully hereinafter from the following description taken in connection with the accompanying drawings, in which.

DETAILED DESCRIPTION OF THE PREFERRED EMBODIMENTS

Figure 1:
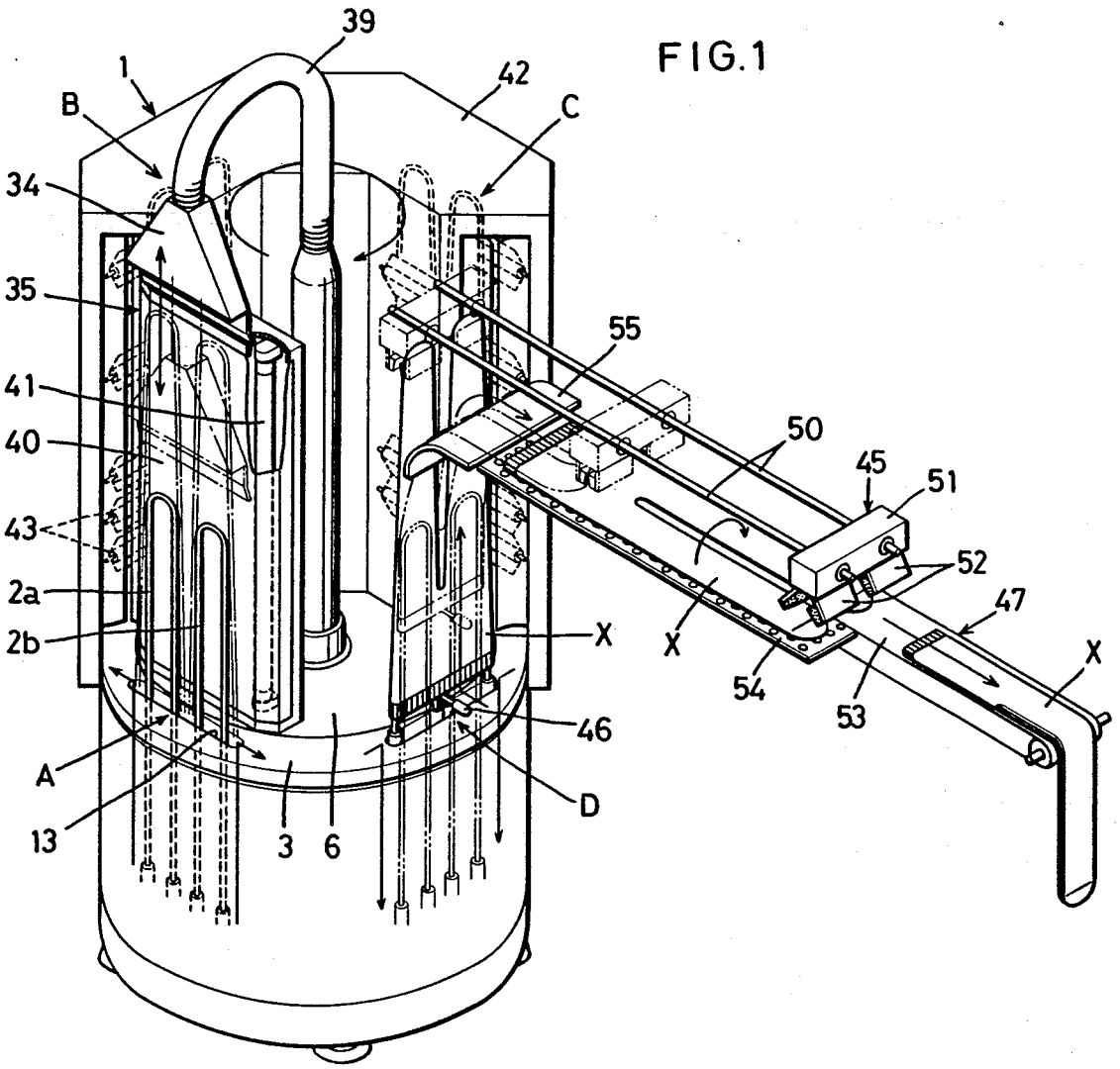
FIG. 1 is a perspective view of a pantyhose finishing apparatus according to the invention.
Figure 2:
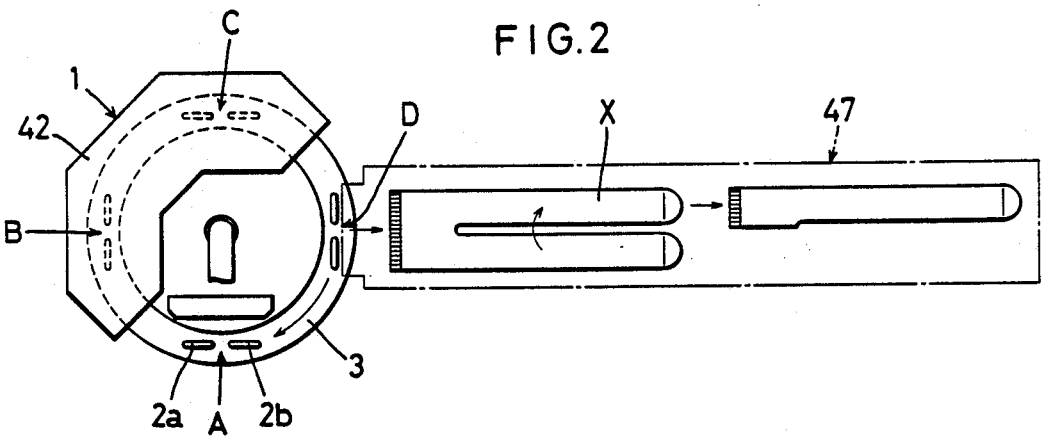
FIG. 2 is a plan view of the same.

The preferred embodiment of this invention shown in FIGS. 1 and 2 includes four pairs of pattern frames 2*a*, 2*b*, each pair configured to receive a pair of pantyhose thereon, and each frame being made of a metal rod such as stainless steel pipe bent into an inverted U or hairpin shape. The frames are mounted on a ring plate 3 at predetermined angular intervals. The ring plate 3 revolves and intermittently stops at the predetermined angular intervals. The stops occur at: inspecting station A where a pair of pantyhose are fitted on the pattern frames for inspection, drying stations B and C where the pantyhose on the pattern frames are dried and heat-set, and pulling-out station D where the pantyhose are pulled out of the pattern frames to allow them to be folded and packaged.

Figure 3:
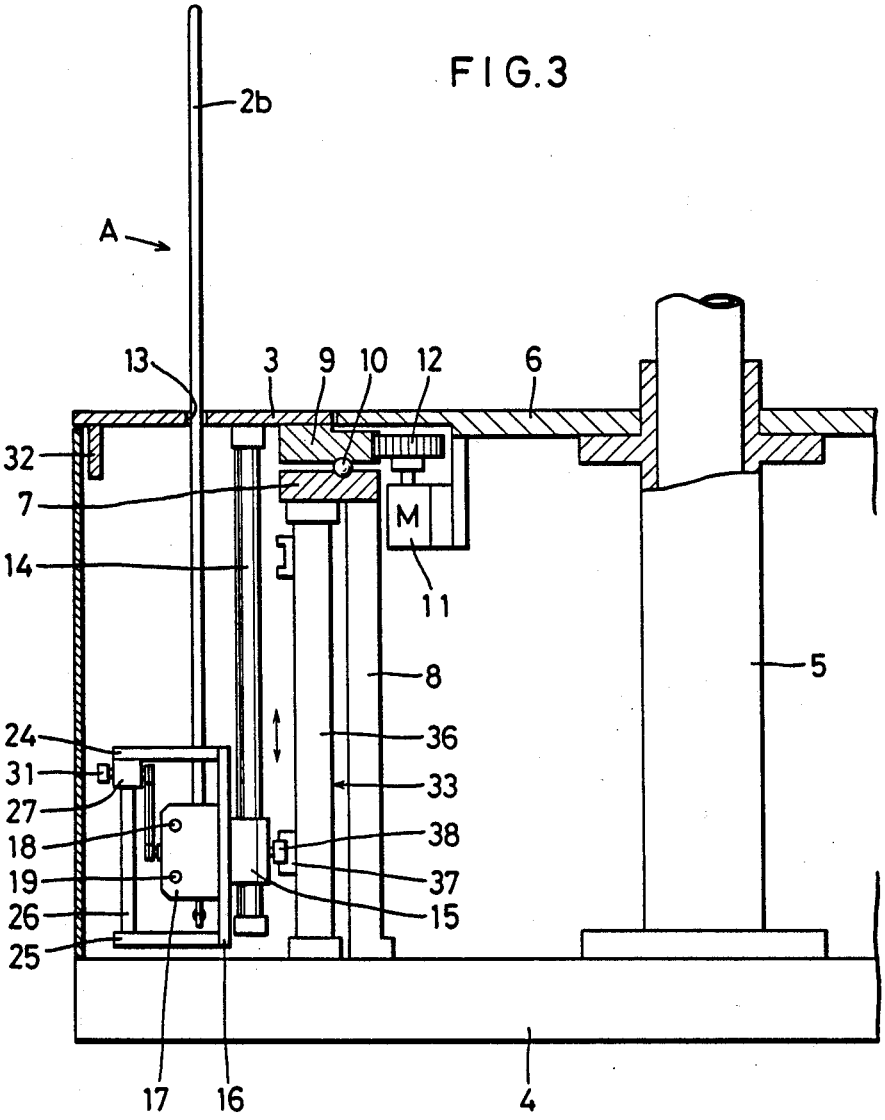
FIG. 3 is a vertical cross-sectional view of an inspecting station of the apparatus, pantyhose being fitted on pattern frames at this station.

FIG. 3 shows the apparatus 1 in cross-section with ring plate 3 stopped at the inspecting station. A flanged shaft 5 is fixed in an upright position to the center of a bed 4 of the apparatus 1, a disc 6 is immovably fixed to the flanged shaft 5, and the ring plate 3, supported by a ring support 7 fixed to the top of a stay 8, is disposed around the disc 6 and adjacent thereto, the ring plate revolving freely around the disc 6.

To be more specific, the ring plate 3 is revolved around the disc 6, making intermittent stops at every 90° angular interval, by an internal gear 9 which is provided at the inside undersurface of the ring plate and engages a driving gear 12 having a geared motor 11. The gear 12 is secured under the circumferential portion of the disc 6. A ball bearing 10 is disposed between the undersurface of the internal gear 9 and the upper surface of the ring support 7 in order to facilitate a smooth revolution of the ring plate 3.

As seen in the figures, four slits or elongated holes 13 are bored through the ring plate 3 with their longitudinal axes oriented parallel to the tangential direction of the ring plate 3 in such a way as to receive a pair of pattern frames 2*a*, 2*b*, respectively, and allow them to move up and down in the vertical direction.

As shown in FIG. 3, a guide shaft 14, secured to the undersurface of the ring plate 3, extends downwardly to a location near the upper surface of the bed 4. Also, a carrier plate 16 is slidably mounted on the guide shaft 14 by means of a slider 15. A pair of brackets 17, 17 (FIGS. 5 and 7) are provided on the other side of the carrier plate 16 with respect to the slider 15. A pair of minor guide shafts 18, 19 are provided with a pair of sliders 20*a*, 21*a* or 20*b*, 21*b*, respectively.

Each pair of pattern frames 2*a*, 2*b*, made of a metal rod, such as stainless steel pipe, has an inverted U or hairpin shape so that the distance or width between the legs thereof is variable due to the elasticity of the rod. As for one 2*a* of the paired pattern frames 2*a*, 2*b*, one of its legs is fixed to the slider 20*a* of the upper guide shaft 18, and the other is fixed to the slider 21*a* of the lower guide shaft 19. Likewise, as for the other pattern frame 2*b*, one of its legs is fixed to the slider 20*b* of the upper guide shaft 18, and the other is fixed to the slider 21*b* of the lower guide shaft 19. The pattern frames 2*a*, 2*b* stand upright in pairs, and are adapted to move up and down in the vertical direction within the slits 13.

The sliders 20*a*, 20*b* on the upper guide shaft 18 are spaced apart a certain distance by means of a connecting rod 22. The sliders 21*a*, 21*b* on the lower guide shaft 19 are also spaced apart a certain distance by a connecting rod 23 in a similar manner.

A vertical shaft 26 is provided between upper and lower stoppers 24, 25 fixed to the center line of the carrier plate 16. Mounted on the vertical shaft 26 is a slider 27, which is connected to the slider 20*a* with a crank shaft 28 on the one hand, and is connected to the slider 21*b* with a crank shaft 29 on the other hand. The sliders 20*a*, 21*b*, spaced farthest apart are connected with a spring 30 so that both are always urged toward each other by the elastic force of the spring 30.

Figure 5:
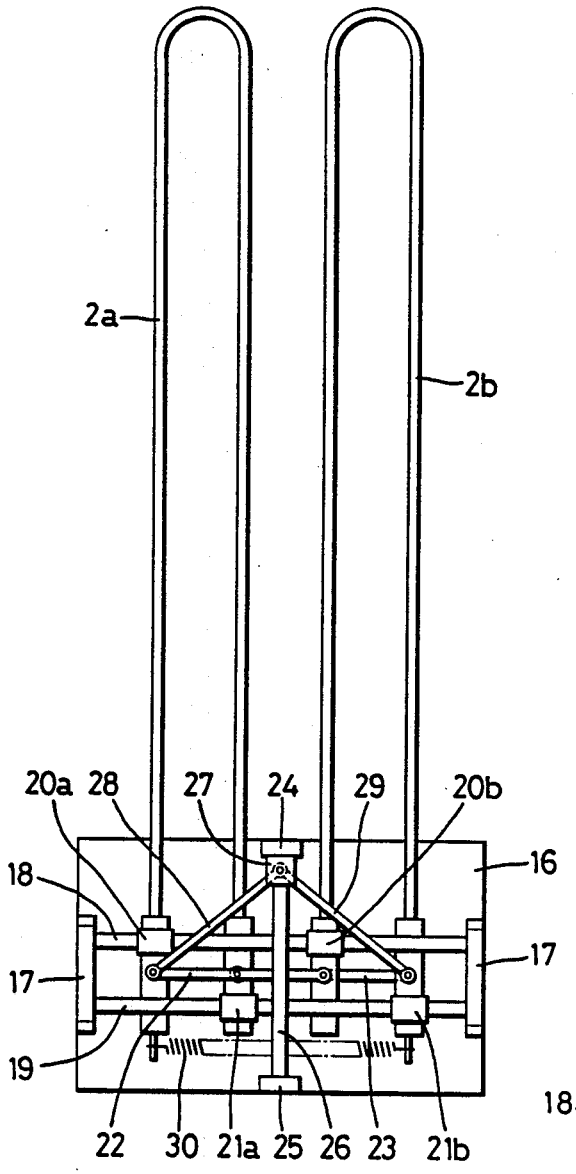
FIG. 5 is an elevational view of a device employed in the invention by which a pair of pattern frames are supported in such a way as to widen or narrow the frames, wherein the pattern frames shown in this figure are in the narrowed position.
Figure 7:
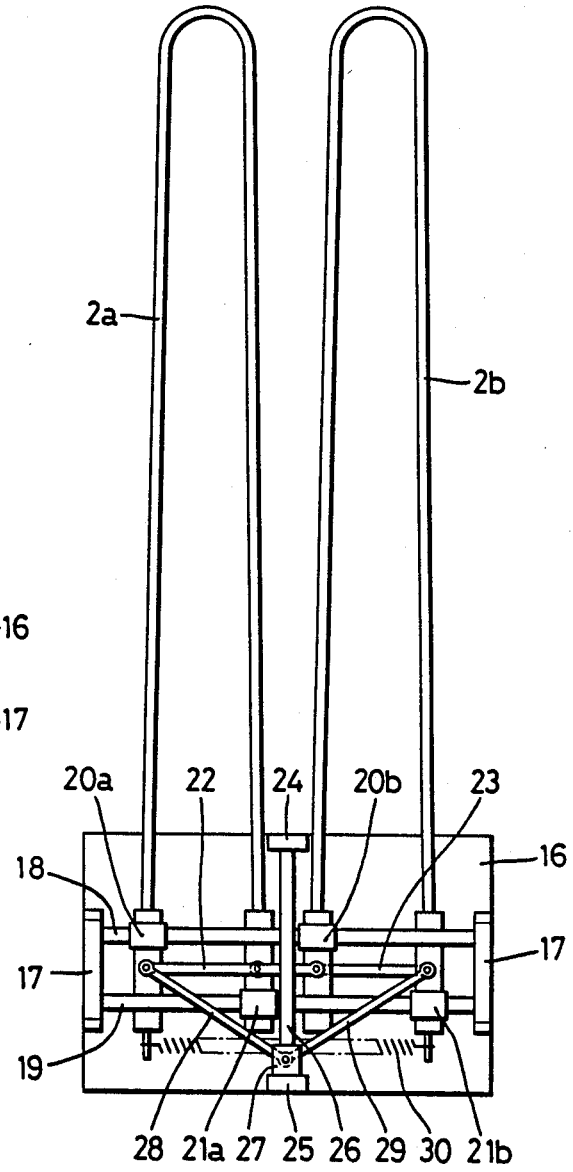
FIG. 7 is an elevational view of the device shown in FIG. 5, wherein the pattern frames shown in this figure are in the widened position.
Figure 6:
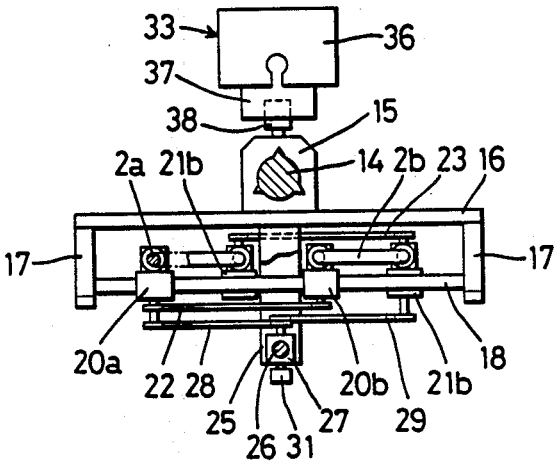
FIG. 6 is a plan view of the device shown in FIG. 5.

When the center slider 27 is in the lifted position, butted against the upper stopper 24 shown in FIG. 5, the sliders 20*a*, 21*b* are closest to each other, with the result that not only are the sliders 20*a*, 21*a* closest to each other but the sliders 20*b*, 21*b* are also closest to each other. In this way, the space between the two legs becomes narrowed in each of the frames of the pair of pattern frames 2*a*, 2*b*. Likewise, when the center slider 27 is in the lowered position, butted against the lower stopper 25 as shown in FIG. 7, the sliders 20*a*, 21*b* are pulled apart, with the result that the sliders 20*a*, 21*a* and the sliders 20*b*, 21*b* are spaced farthest apart from one another. In this way, the space between the two legs of the respective pattern frames 2*a*, 2*b* is widest.

Also, since the sliders 20*a*, 21*b* are always urged toward each other by the spring 30, the center slider 27 is automatically butted against either the upper stopper 24 or the lower stopper 25 once it passes the dead point where the crank shafts 28, 29 extend along the same straight line.

As shown in FIG. 3, a roller 31 is provided on the front surface of the center slider 27, and a butting rod 32 projects from the outer periphery of the undersurface of the ring plate 3. Thus, when the roller 31 is butted against the butting rod 32 during the ascent of the carrier plate 16, the slider 27, then butted against the upper stopper 24, is pushed back downward in such a way as to butt against the lower stopper 25, whereby the space between the two legs of the pattern frames 2*a*, 2*b* is widened.

As shown in FIGS. 1 and 3, at the inspecting station A, where every pair of pattern frames 2*a*, 2*b* makes a stop, there are provided a device 33 for elevating pattern frames 2*a*, 2*b*, whose lower half is still under the ring plate 3, whereby the entire pair of frames is lifted above the ring plate 3, a device 34 for exerting suction on the toe portion of pantyhose supported on the frames, which device 34 moves up and down in the vertical direction with the up-and-down movement of the pattern frames 2*a*, 2*b*, and a device 35 for illuminating pantyhose from behind to allow the inspection thereof, which device 35 is fixed on the disc 6 firmly.

As shown in FIG. 3, the elevating device 33 is essentially a rodless cylinder 36 vertically spanning the bed 4 and the ring support 7, and a grooved cam 37 upwardly or downwardly moved by the rodless cylinder 36. When the carrier plate 16 comes around to the inspecting station A, a roller 38 of the slider 15 and the grooved cam 37, which is positioned to receive the roller 38 in the lowered position of the carrier plate, are engaged so that once operators switch on the rodless cylinder 36, the grooved cam 37 is lifted, whereby the carrier plate 16, on which the pattern frames 2*a*, 2*b* are mounted, is lifted therewith.

The suction device 34 is connected to a suction means by a length of flexible hose 39, and is moved up and down in the vertical direction concurrently with the up-and-down movement of the pattern frames 2*a*, 2*b* by a driving means such as a hydraulic cylinder. When a pair of pantyhose X is fitted on a pair of pattern frames 2*a*, 2*b* disposed in the lowered position, the suction device 34 exerts suction on the toe portion of the pantyhose, during which time operators can smoothly put the pattern frames 2*a*, 2*b* in the mouth of the pantyhose with exactness.

The illuminating device 35 is essentially a light source 41 encased in a translucent box 40. It is installed behind the pattern frames 2*a*, 2*b* in such a way as to be able to illuminate pantyhose X from behind so that any sort of defect can be found by visual inspection.

At the drying stations B and C, there are provided a drying chamber on the disc 6 and a long wave infrared heater 43 housed therein. The drying chamber 42 is firmly mounted on the disc 6 in such a way as to cover the pattern frames that come around in it. The infrared heater 43 serves to not only dry pantyhose but also to set the pantyhose with its heat while they are being widened on a pair of widened pattern frames.

Among the many types of infrared heaters that can be employed are the bulb-type, tube-type, and plate-type infrared heaters for example. All of these types are useful and advantageous because they can dry pantyhose in a short time and never scorch them even if the apparatus should stop for some reason or other. Besides, long wave infrared rays so strongly penetrate objects and heat them by causing their molecules to oscillate that their effectiveness in heating is very great.

At the pulling-out station D, there are provided a device 44 (FIG. 4) for lowering the pattern frames 2*a*, 2*b* to their lowest position, a device 45 (FIG. 1) for automatically pulling pantyhose X out of the pattern frames by returning to a retracted position after having clamped the toe portion of the pantyhose X at an advanced position just above the pattern frames 2*a*, 2*b*, a device 46 (FIG. 1) for tucking-up the mouth portion of the pantyhose X while the pulling-out device 45 is pulling out pantyhose, which device 46 is designed to freely move forward and backward, or upward and downward in the space between a pair of pattern frames 2*a*, 2*b*, and a device 47 (FIG. 2) for receiving flattened pantyhose and folding it in two, which device 47 is located just under the automatic pulling-out device 45.

Figure 4:
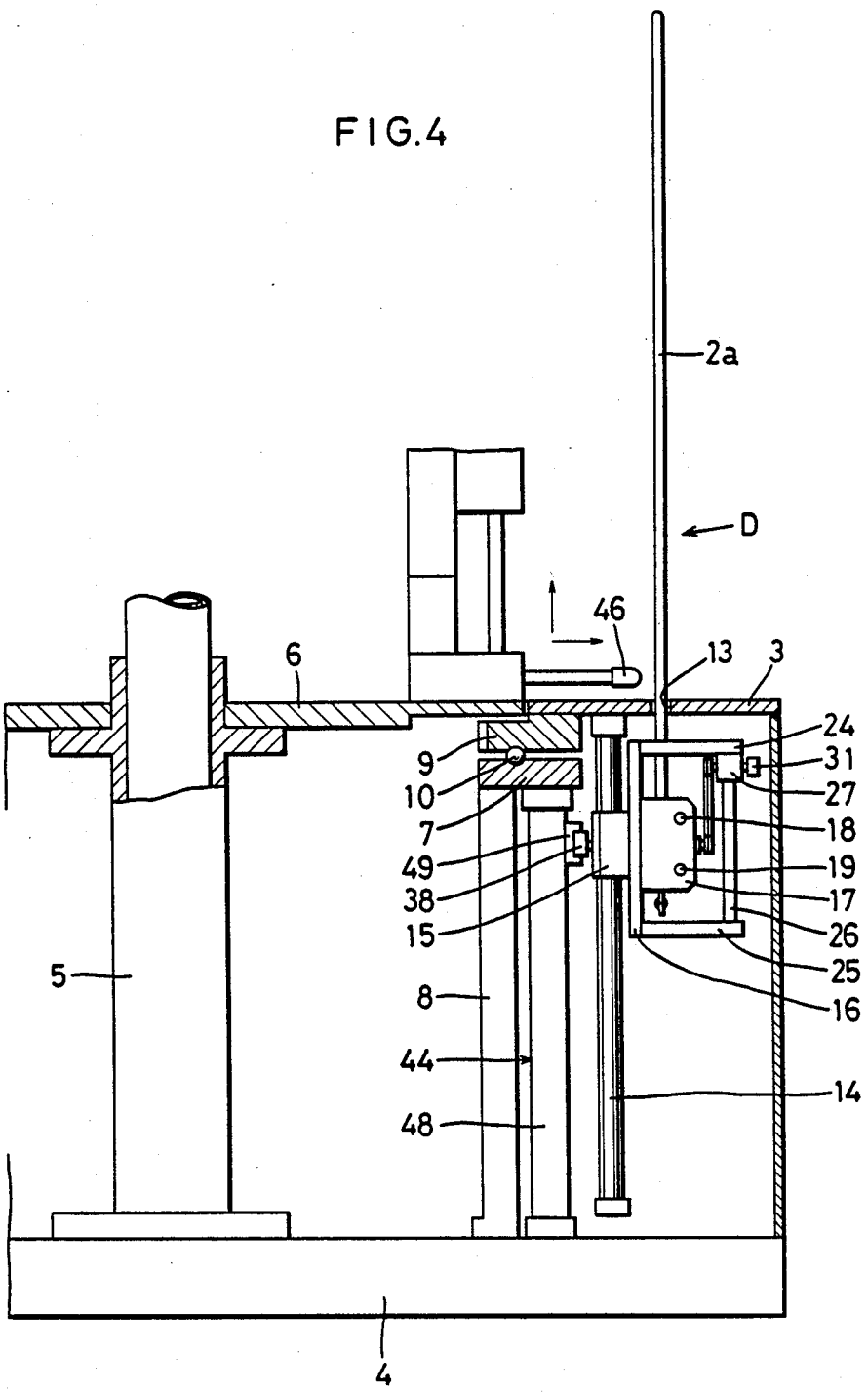
FIG. 4 is a vertical cross-sectional view of a pulling-out station of the apparatus, pantyhose being taken off from pattern frames at this station.

As shown in FIG. 4, the lowering device 44 is essentially a rodless cylinder 48 and a grooved cam 49 similar to the elevating device 33 at the inspecting station A. It is designed to lower the pattern frames 2*a*, 2*b* by the coupling of the roller 38 of the slider 15 and the grooved cam 49 when the carrier plate 16 comes around to the pulling-out station in a raised position.

Figure 8:
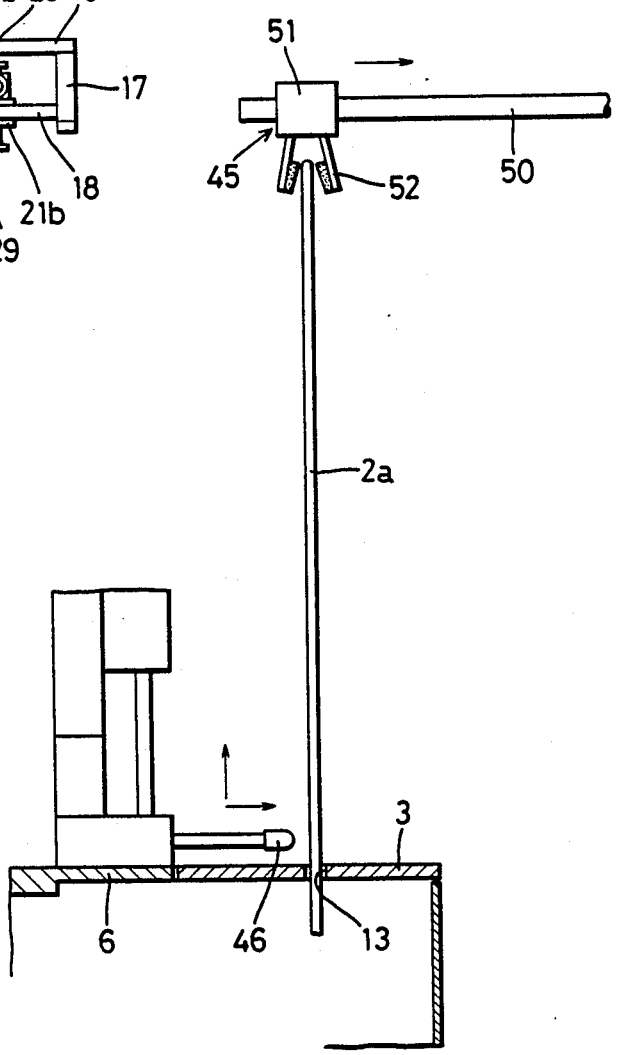
FIG. 8 is a schematic diagram showing a mechanism for taking pantyhose out of the pattern frames in the apparatus of the invention.

As shown in FIGS. 1 and 8, the automatic pulling-out device 45 is essentially a pair of guide shafts 50, 50, a slidable block 51 that can be moved along the guide shafts 50, 50 by a driving means such as hydraulic cylinder, and a device 52 for clamping the toe portion of pantyhose X, which device 52 is fixed to the undersurface of the movable block 51. The clamping device 52 is placed at its advanced position with its jaws wide open, and kept waiting for pantyhose coming around to the pulling-out station D. As soon as the clamping device 52 clamps the toe portion of the pantyhose with its jaws, the slidable block 51 retreats to the retracted position shown by a solid line in FIG. 1, whereby the pantyhose X is pulled out of the pattern frames having been lowered by the lowering device 44.

The tucking-up device 46 is disposed on the disc 6 in such a way that it can exactly face the middle of the space between the two pattern frames 2a, 2b. Because the tucking-up device 46 can be advanced or retracted, or lifted or lowered, it can be put just under the mouth portion of the pantyhose X when advanced at its lowered position. Thus, the pantyhose X can be tucked up on the pattern frames by lifting the tucking-up device 46 while in its advanced position. The tucking-up device 46 is retracted after having been lifted to the lifted position, and is then lowered while in a retracted position. The movement of the tucking-up device is such that it does not interrupt the revolution of the pattern frames 2a, 2b around the disc 6.

The folding device 47 is essentially a belt conveyor 53, a perforated plate 54 for exerting suction on pantyhose X while in a flattened state, which plate 54 is disposed close to one side of the conveyor 53, and a circularly curved guide plate 55, as shown in FIG. 1. A pair of pantyhose X, once pulled out of the pattern frames 2a, 2b by the clamping device 52, are supported by the conveyor 53 and the perforated plate 54. Then, they are folded in two in such a manner that one of the paired hose is put on the other by the turning of the perforated plate 54 onto the top of the conveyor 53. After the perforated plate 54 is turned back, having released the hose, the conveyor 53 forwards the folded pantyhose X to the next packaging station.

Figure 9:
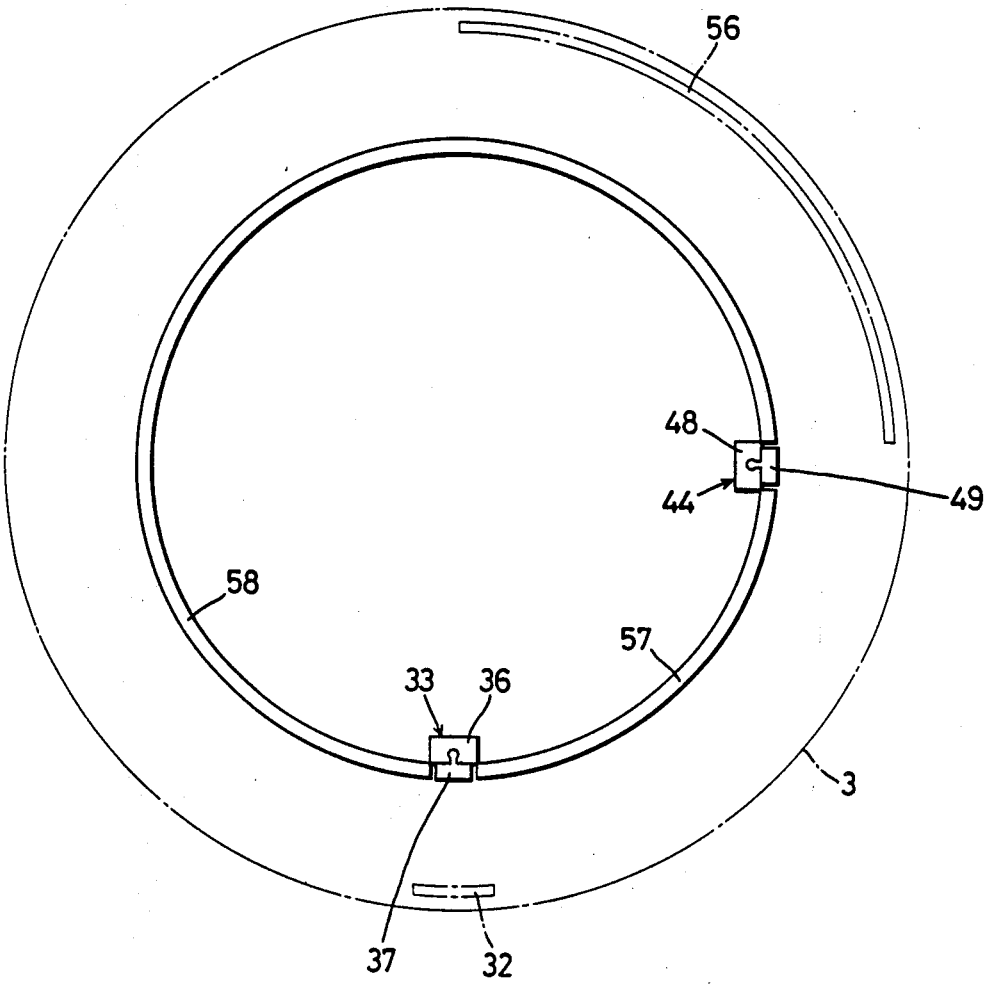
FIG. 9 is a plan view showing a grooved rail and an inclined cam in the apparatus of the present invention.

As shown in FIG. 9, there is provided an inclined cam 56 between the drying station C and the pulling-out station D, whereby the roller 31 of the slider 27 can be pushed upward to the upper stopper 24, and the width of the respective pattern frames 2a, 2b is narrowed in such a manner as to facilitate the pulling-out of pantyhose from the pattern frames at the pulling-out station D.

As shown in FIG. 9, there is provided a grooved rail 57 between the pulling-out station D and the inspecting station A, whereby the pattern frames 2a, 2b are kept in the lowered position due to its coupling with the roller 38 of the slider 15. Moreover, there is provided another grooved rail 58 extending from the inspecting station A to the pulling-out station D by way of the drying stations B and C, whereby the pattern frames are kept in the lifted position due to its coupling with the roller 38 of the slider 15.

Figure 12:
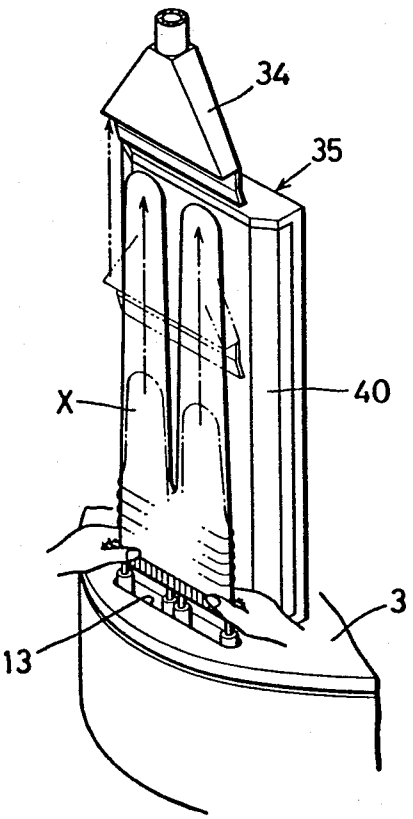
FIGS. 10 through 12 are perspective views showing a procedure according to which pantyhose are fitted on the pattern frames of the apparatus of the present invention.
Figure 11:
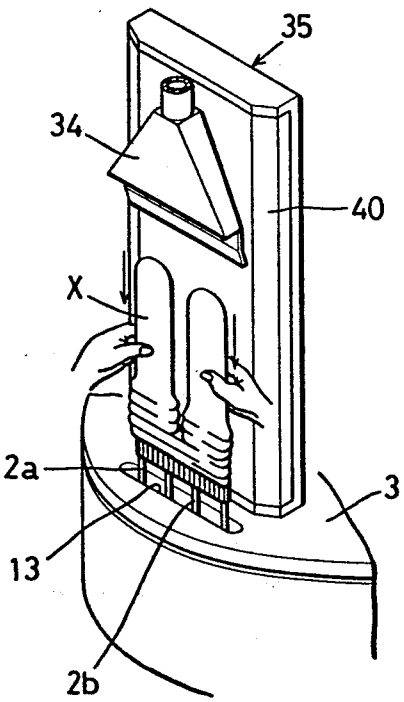
Figure 10:
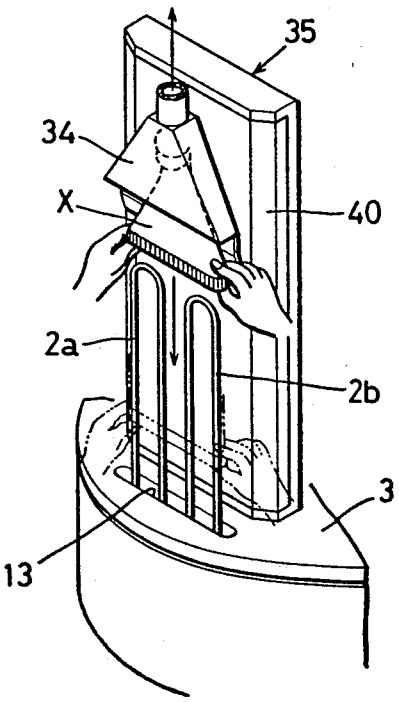

Now that the apparatus 1 according to the invention has been described, the operation thereof will be described in detail. To begin with, an operator fits a pair of pantyhose on a pair of pattern frames at the inspecting station A, as shown in FIGS. 10 through 12, and checks the pantyhose to see if there are any defects in them. As shown in FIG. 10, firstly, a pair of pantyhose X, of which the toe portion is being held by the suction device 34, is brought to a position above a pair of pattern frames 2a, 2b located in the lowered position. The pantyhose are fitted onto the pair of frames as shown in FIG. 11. At this time, the upper half of the pantyhose near the toe portion is spread for inspection, while the lower half thereof is still unspread. Next, the pattern frames are lifted by means of the elevating device 33 actuated by a pedal switch, for example, and the pantyhose X are stretched with its mouth being held by hands, as shown in FIG. 12, before the inspecting of the lower half of the pantyhose X.

If it is ascertained that the pantyhose has no defects, the ring plate 3 is revolved by 90°; then, another pair of pattern frames come around to the inspecting station A. While the first pattern frames pass the two drying stations B and C, the pantyhose X on the pattern frames are dried by the infrared heater 43, are set in the shape of the pattern frames, and become free of wrinkles.

After having passed the station C, the pattern frames with the pantyhose on them are narrowed on their way to the station D because the roller 31 of the slider 27 is pushed upward to the upper stopper 24 by its coupling with the inclined cam 56.

At the pulling-out station D, the clamping device 52 of the automatic pulling-out device 45 is waiting for the pantyhose X. Once the toe portion of the pantyhose has been put between a pair of jaws of the clamping device 52, the jaws clamp it and the pattern frames are lowered concurrently by the lowering device 44.

The clamping device 52 of the automatic pulling-out device 45 is moved to the retracted position from the advanced position in such a way as to lay the pantyhose X taken off the pattern frames 2a, 2b flat on the folding device 47 concurrently with the upward movement of the tucking-up device 46 which raises the mouth portion of the pantyhose X.

In this way, the pantyhose are pulled smoothly out of the pattern frames 2a, 2b. They are folded in two neatly by the perforated plate 54 of the folding device 47 putting them on the conveyor 53 with one of the paired hose laid on the other while exerting suction on the first. They are forwarded to the next packaging station by the conveyor 53.

The pattern frames having returned to the inspecting station A are put in the lowered position in order for a new pair of pantyhose to be placed thereon.

As stated above, according to the apparatus 1 of this invention, every finishing process of dyed pantyhose can be automatically carried out, except for the manual fitting of the pantyhose on the pattern frames at the inspecting station A. Therefore, it is possible to save substantial manpower and greatly improve the productivity in producing the pantyhose, whereby the production cost of the pantyhose can be kept relatively low.

What is claimed is:

1. An apparatus for finishing pantyhose comprising:

a ring-shaped plate rotatably mounted in the apparatus;

a plurality of spaced-apart and vertically movable pairs of pattern frames mounted to said ring-shaped plate so as to be rotatable therewith in the apparatus, each of the frames of said pairs of pattern frames comprising a metal rod having a pair of leg portions extending in an inverted U-shape and adapted to receive a respective hose portion of a pair of pantyhose thereon wherein each of said pairs of frames is adapted to receive thereon a respective pair of pantyhose;

drive means operatively connected to said ring-shaped plate for rotating said plate in the apparatus and stopping the ring-shaped plate intermittently at predetermined angular intervals to progressively locate said pairs of frames rotating with said ring-shaped plate at positions defining an inspection station, a drying station and a pulling-out station in the apparatus;

elevating means engageable with said pairs of frames at the inspection station for moving said pairs of frames when at the inspection station vertically upward in the apparatus;

spreading means operatively connected to said pairs of pattern frames at the inspection station for spreading the leg portions of the frames at the inspection station;

an infrared heater disposed at the drying station for subjecting pantyhose supported on the pairs of frames at the drying station to infrared radiation;

lowering means engageable with said pairs of frames at the pulling-out station for moving said pairs of frames at the pulling-out station vertically downward in the apparatus; and clamping means at said pulling-out station for clamping the toe portion of pantyhose on the pairs of pattern frames at the pulling-out station prior to the pairs of frames being lowered by said lowering means.

2. An apparatus as claimed in claim 1, and further comprising suction means at the inspection station above the pairs of frames when at the inspection station for exerting suction on the toe portions of pantyhose as the mouth portions of the pantyhose are placed over the pairs of frames at the inspection station, said suction means being movable vertically upward at the inspection station in synchronism with the upward vertical movement of said pairs of frames at the inspection station.

3. An apparatus as claimed in claim 1, and further comprising a pulling-out device connected to said clamping means for retracting said clamping means from an advanced position thereof at which said clamping means clamps pairs of pantyhose supported on said pairs of frames at the pulling-out station to a retracted position of the pulling-out device so as to remove the pantyhose from said pairs of frames.

4. An apparatus as claimed in claim 3, and further comprising a tucking device at the inspection station, said tucking device being movable horizontally in and out of a space located between the frames of respective said pairs of pattern frames at the inspection station, and said tucking device being vertically movable between the frames of said respective pairs of frames.

5. An apparatus as claimed in claim 3, and further comprising a transport means disposed adjacent the pulling-out station for transporting pantyhose removed from said pairs of frames by said clamping means and said pulling-out device, and folding means associated with said transport means and disposed below an area defined between the advanced and the retracted positions of said clamping means for folding pantyhose in two on said transport means.

6. An apparatus as claimed in claim 1, wherein said plurality of pairs of pattern frames are spaced apart on said ring-shaped plate by angular intervals which correspond to angular intervals at which the inspection station, the drying station and the pulling-out station are spaced apart with respect to said ring-shaped plate.

7. An apparatus for finishing pantyhose comprising:

a ring-shaped plate rotatably mounted in the apparatus;

a plurality of spaced-apart and vertically movable pairs of pattern frames mounted to said ring-shaped plate so as to be rotatable therewith in the apparatus, each of the frames of said pairs of pattern frames comprising a metal rod having a pair of leg portions extending in an inverted U-shape and adapted to receive a respective hose portion of a pair of pantyhose thereon wherein each of said pairs of frames is adapted to receive thereon a respective pair of pantyhose;

drive means operatively connected to said ring-shaped plate for rotating said plate in the apparatus and stopping the ring-shaped plate intermittently at predetermined angular intervals to progressively locate said pairs of frames rotating with said ring-shaped plate at positions defining an inspection station, a drying station and a pulling-out station in the apparatus;

elevating and spreading means engageable with said pairs of frames at the inspection station for moving said pairs of frames when at the inspection station vertically upward in the apparatus and for spreading the leg portions of the frames at the inspection station to facilitate the visual inspection of pantyhose disposed over the frames at the inspection station;

an infrared heater disposed at the drying station for subjecting pantyhose supported on the pairs of frames at the drying station to infrared radiation; and pulling-out means disposed at the pulling-out station for removing pantyhose from the pairs of pattern frames when at the pulling-out station.

* * * * *